US006363611B1

(12) United States Patent
Sheldon et al.

(10) Patent No.: US 6,363,611 B1
(45) **Date of Patent: *Apr. 2, 2002**

(54) METHOD OF MAKING AN EASILY DISASSEMBLED ROTOR ASSEMBLY FOR A CENTRIFUGAL SEPARATOR

(75) Inventors: Bret V. Sheldon; William D. Flim; Gilbert Mendoza; Lawrence L. Macaluso, all of Carson City, NV (US)

(73) Assignee: Costner Industries Nevada, Inc., Carson City, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,008

(22) Filed: Nov. 16, 1998

(51) Int. Cl.[7] ..... B21D 53/00; B04B 1/04; B04B 7/12; B04B 15/06

(52) U.S. Cl. ..... 29/889; 494/64; 494/65; 494/79

(58) Field of Search ..... 494/22, 38, 43, 494/56, 64, 65, 74, 75, 79, 67; 29/428, 434, 525.02, 888.025, 889, 889.2, 888.02

(56) References Cited

U.S. PATENT DOCUMENTS

| | | | | | |
|---|---|---|---|---|---|
| 720,154 | A | * | 2/1903 | Kimball | 494/64 |
| 732,886 | A | * | 7/1903 | Odell et al. | 494/74 |
| 733,585 | A | * | 7/1903 | Hult et al. | 494/64 |
| 792,577 | A | * | 6/1905 | Fleege | 494/64 |
| 935,183 | A | * | 9/1909 | Wolf | 494/74 |
| 952,686 | A | * | 3/1910 | Philips | 494/64 |
| 1,644,615 | A | * | 10/1927 | Sharples | 494/64 |
| 2,563,550 | A | | 8/1951 | Quist | |
| 2,819,014 | A | * | 1/1958 | Zabriskie, Jr. | 494/22 |
| 4,649,612 | A | * | 3/1987 | Sakamaki et al. | 29/428 |
| 4,824,430 | A | * | 4/1989 | Kashihara et al. | 494/22 |
| 4,857,040 | A | * | 8/1989 | Kashihara et al. | 494/22 |
| 4,959,158 | A | | 9/1990 | Meikrantz | |
| 4,991,766 | A | * | 2/1991 | Hunnicutt, III et al. | 29/889 |
| 5,254,076 | A | * | 10/1993 | Chow et al. | 494/65 |
| 5,571,070 | A | * | 11/1996 | Meikrantz et al. | 494/65 |
| 5,591,340 | A | | 1/1997 | Meikrantz et al. | |

* cited by examiner

*Primary Examiner*—Charles E. Cooley
(74) *Attorney, Agent, or Firm*—Blakely, Sokoloff, Taylor & Zafman LLP

(57) ABSTRACT

A five-part rotor assembly is easily disassembled for cleaning and/or sterilization. The five parts comprise a rotor sleeve, a rotor head, a weir plate, a rotor cover and an internal vane package. Each of these parts is machined as a unitary piece or otherwise fabricated without weldments.

12 Claims, 3 Drawing Sheets

METHOD OF MAKING AN EASILY DISASSEMBLED ROTOR ASSEMBLY FOR A CENTRIFUGAL SEPARATOR

BACKGROUND OF THE INVENTION

1. Field of the Invention

This invention relates generally to the field of centrifugal separators for separating liquids of different densities and, more particularly, to a non-welded, easily disassembled rotor assembly for such separators.

2. Prior Art

Centrifugal devices are widely used for separating materials of different densities. Such devices have been found to provide a highly satisfactory method of separating mixed liquids from one another, provided that the liquid components have different densities. Conventional centrifugal separators employ a complex rotor structure to mix and separate the component phases. Typically, the various parts of the rotor assembly are welded together. Such welded construction has certain disadvantages in some fields of use.

Medical and pharmaceutical applications have very stringent cleanliness requirements. Conventional welded rotor assemblies are not suitable for such applications. First of all, a welded structure cannot be readily disassembled for cleaning or sterilization. Secondly, in order to comply with good manufacturing practices established for medical and pharmaceutical applications, all welds would need to be ground and polished, thereby complicating the fabrication process.

A need therefore exists for a centrifugal separator rotor assembly that is free of weldments and can be easily disassembled.

SUMMARY OF THE INVENTION

The present invention comprises a five-part rotor assembly that can be easily disassembled for cleaning and/or sterilization. The five parts comprise a rotor sleeve, a rotor head, a weir plate, a rotor cover and an internal vane package. Each of these parts is machined as a unitary piece or otherwise fabricated without weldments.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
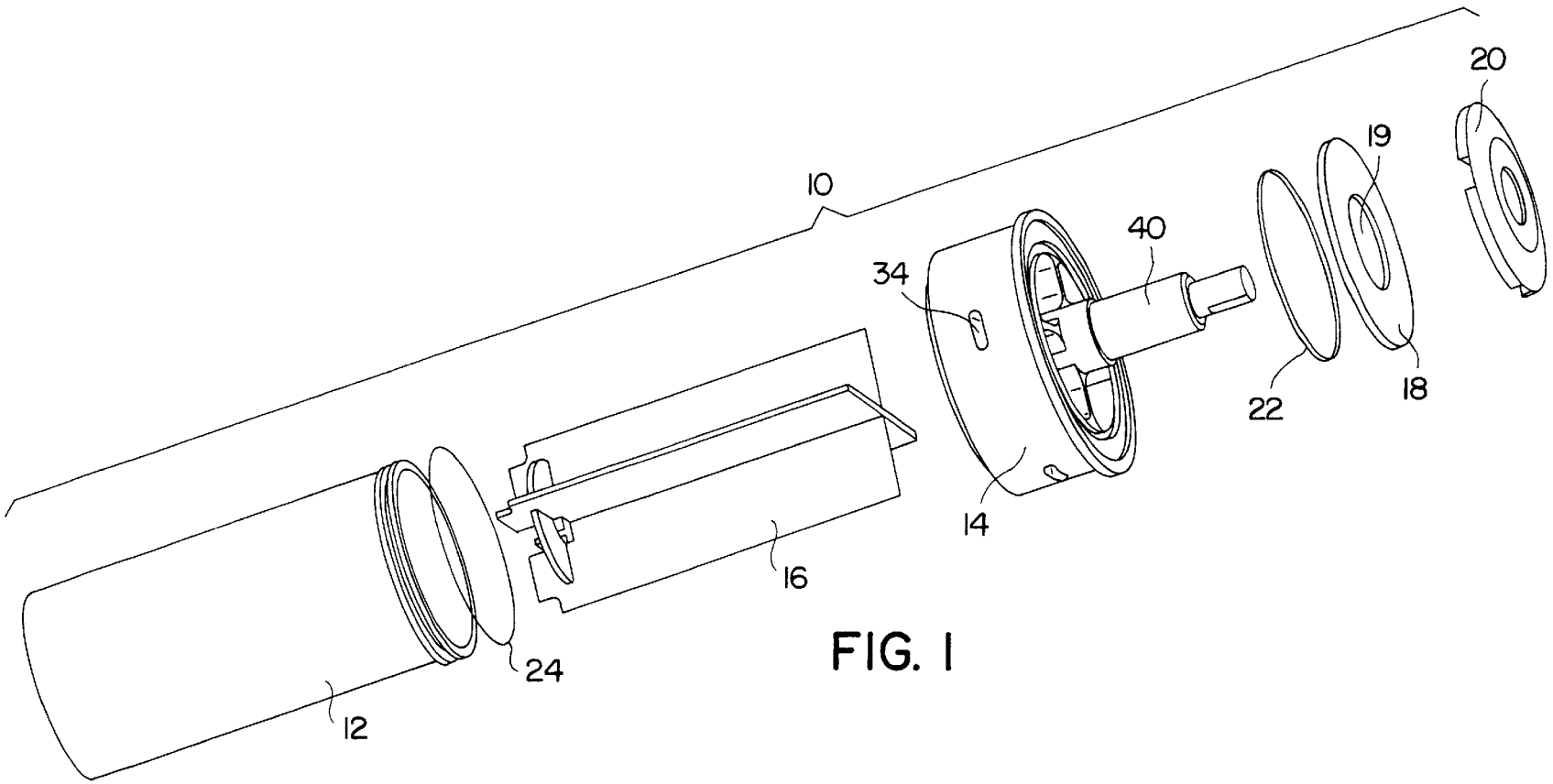
FIG. 1 is an exploded view of the rotor assembly of the present invention.
Figure 3:
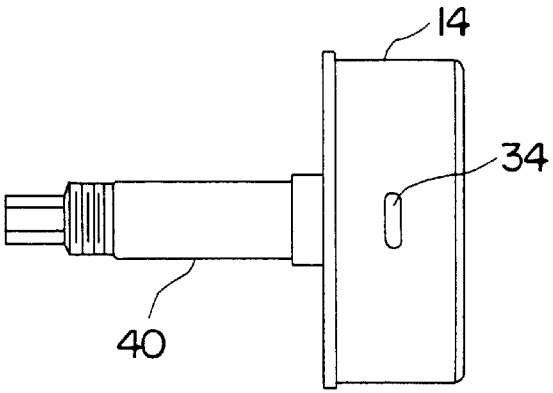
FIG. 3 is a side elevation view of the rotor head.
Figure 2:
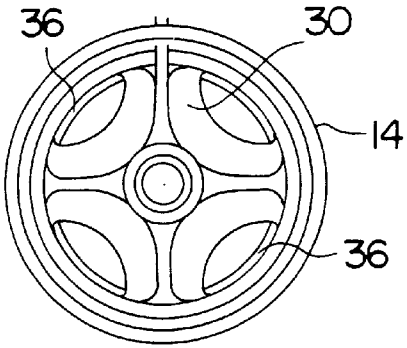
FIG. 2 is a top plan view of the rotor head.
Figure 5:
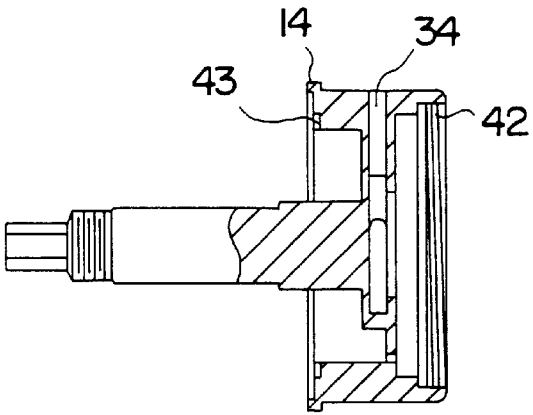
FIG. 5 is a cross-sectional view of the rotor head taken through line 5—5 of FIG. 4.
Figure 4:
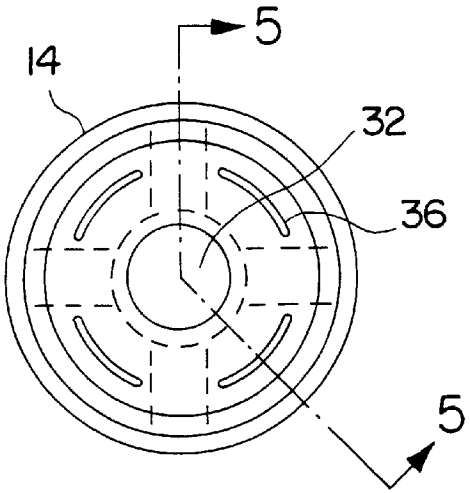
FIG. 4 is a bottom plan view of the rotor head.

FIG. 1 is an exploded view illustrating a rotor assembly 10 in accordance with the present invention. The principal components of the rotor assembly are the rotor sleeve 12, the rotor head 14 and the rotor vane package 16. The vane package fits within the rotor sleeve and is retained therein by the rotor head, which threads onto the rotor sleeve. Weir plate 18 is held in place on the top of the rotor head by rotor cover 20. Rotor cover 20 is secured by a seal ring (not shown) which goes over shaft 40. A bearing assembly (also not shown), which is attached to shaft 40, effectively sandwiches the seal ring, rotor cover 20 and weir plate 18. O-ring 22 ensures a fluid-tight seal between weir plate 18 and rotor head 14. A second O-ring 24 ensures a fluidtight seal between rotor sleeve 12 and rotor head 14.

FIGS. 2–5 illustrate the detailed construction of rotor head 14. During operation of the separator, lighter phase components enter slinger 30 through central aperture 32 and exit radially through slots 34. Heavier phase components bypass slinger 30 through slots 36. The higher density components exit rotor head 14 through aperture 19 in weir plate 18.

Rotor head 14 includes shaft 40 which is supported within the separator housing by bearings (not shown) and couples to a motor (also not shown) for rotation of the entire rotor assembly 10. In the exemplary embodiment illustrated and described herein, the separator is of a suspended rotor design. However, the invention is also applicable to separators having rotors with lower support shafts. Rotor head 14 is internally threaded at 42 for mating engagement with the rotor sleeve. An annular channel 43 is provided to receive O-ring 22.

In a preferred embodiment, rotor head 14 is machined from a unitary piece of material so as to avoid any weldments or other joints. The particular material will be selected for compatibility with the process chemicals and may include, for example, various stainless steel or aluminum alloys or composite materials.

Figure 6:
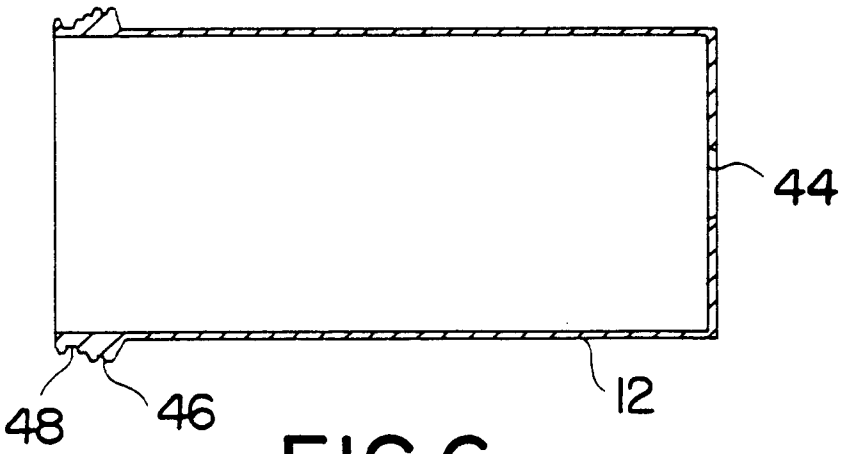
FIG. 6 is a cross-sectional view of the rotor sleeve.

FIG. 6 is a cross-section view of rotor sleeve 12. The rotor sleeve is a hollow can-like structure with an aperture 44 in the bottom thereof through which the mixed components are admitted for separation. External threads 46 are provided for mating engagement with rotor head 14 as mentioned above. Channel 48 is provided to receive O-ring 24.

Rotor sleeve 12 is preferably spun and/or machined from a unitary piece of material. As with the rotor head, the rotor sleeve will be made of a material selected for compatibility with the intended process and will typically be made of the same material as the rotor head.

Figure 8:
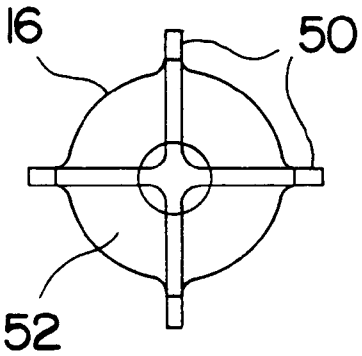
FIG. 8 is a top plan view of the vane package.
Figure 7:
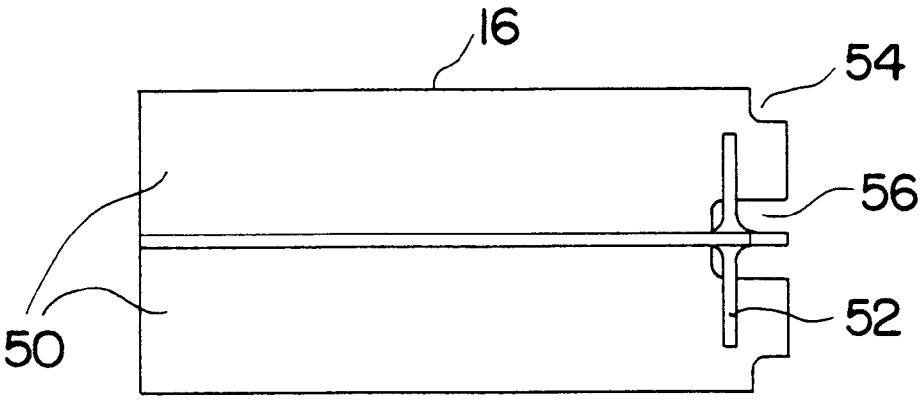
FIG. 7 is a side elevation view of the vane package.

FIGS. 7 and 8 illustrate vane package 16. In the illustrated embodiment, the vane package comprises four vanes 50; however, different numbers of vanes may be used if desired. Weld spots or other similar means may be provided on the inside wall of rotor sleeve 12 to prevent rotation of vane package 16 during operation of the separator. Vane package 16 includes diverter plate 52 proximate to the bottom of vanes 50. Vanes 50 are notched both at 54 and 56. These notches, in combination with diverter plate 52, help to distribute the input component stream within the rotor.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A method of making a rotor assembly for a centrifugal separator comprising:

forming a cylindrical rotor sleeve from a unitary piece of material, said rotor sleeve having a side wall, a bottom portion and a top portion, the bottom portion including a bottom wall and a single central aperture in the bottom wall to admit mixed components for separation;

forming a rotor head from a unitary piece of material, said rotor head having a lower portion in mating engagement with the top portion of the rotor sleeve, said rotor head including means for separating a lower density material from a higher density material;

forming a rotor vane package from a unitary piece of material, said rotor vane package having a plurality of radial vanes extending from the bottom portion of the rotor sleeve to the top portion thereof;

said rotor vane package being removable from the rotor sleeve when the rotor head is separated therefrom;

wherein each of the rotor sleeve, rotor head and rotor vane package is formed without weldments.

2. The method of claim 1 further comprising attaching a top plate to the rotor head.

3. The method of claim 2 wherein the top plate comprises a weir.

4. The method of claim 1 wherein the means for separating comprises a slinger for lower density material.

5. The method of claim 4 wherein the rotor head is formed with a central aperture in communication with the slinger.

6. The method of claim 5 wherein the rotor head is formed with an aperture disposed radially outward from the central aperture to permit higher density material to bypass the slinger.

7. A method of making a rotor assembly for a centrifugal separator comprising:

forming a cylindrical rotor sleeve from a unitary piece of material, said rotor sleeve having a side wall, a bottom portion and a top portion, the top portion having a threaded annular shoulder, the bottom portion including a bottom wall and a single central aperture in the bottom wall to admit mixed components for separation;

forming a rotor head from a unitary piece of material, said rotor head having a lower skirt portion threaded for mating engagement with the annular shoulder of the rotor sleeve, said rotor head including means for separating a lower density material from a higher density material;

forming a rotor vane package from a unitary piece of material, said rotor vane package having a plurality of radial vanes extending from the bottom portion of the rotor sleeve to the top portion thereof;

said rotor vane package being removable from the rotor sleeve when the rotor head is separated therefrom;

wherein each of the rotor sleeve, rotor head and rotor vane package is formed without weldments.

8. The method of claim 7 further comprising attaching a top plate to the rotor head.

9. The method of claim 8 wherein the top plate comprises a weir.

10. The method of claim 7 wherein the means for separating comprises a slinger for lower density material.

11. The method of claim 10 wherein the rotor head is formed with a central aperture in communication with the slinger.

12. The method of claim 11 wherein the rotor head is formed with an aperture disposed radially outward from the central aperture to permit higher density material to bypass the slinger.

* * * * *